US008393487B1

(12) United States Patent
Pillers et al.

(10) Patent No.: US 8,393,487 B1
(45) Date of Patent: Mar. 12, 2013

(54) HYGIENIC TWIST LID FOR INSULATED BEVERAGE CONTAINER

(75) Inventors: Michelle J. Pillers, Kirkland, WA (US); Barry Beyerlein, Seattle, WA (US); Robert Freed, Kenmore, WA (US)

(73) Assignee: Pacific Market International, LLC, Seattle, WA (US)

( * ) Notice: Subject to any disclaimer, the term of this patent is extended or adjusted under 35 U.S.C. 154(b) by 0 days.

(21) Appl. No.: 09/479,410

(22) Filed: Jan. 6, 2000

(51) Int. Cl.

| | |
|---|---|
| ***B65D 51/18*** | (2006.01) |
| ***B65D 43/18*** | (2006.01) |
| ***B65D 41/06*** | (2006.01) |
| ***B65D 51/16*** | (2006.01) |
| ***B67D 3/00*** | (2006.01) |

(52) U.S. Cl. ..... 220/253; 220/717; 220/259.3; 220/301; 220/303; 222/484

(58) Field of Classification Search ..... 215/334; 220/293, 301, 303, 253, 713, 715, 718, 711, 220/255, 256.1, 259.3; 222/548, 484, 481.5; D9/449

See application file for complete search history.

(56) References Cited

U.S. PATENT DOCUMENTS

| | | | | | |
|---|---|---|---|---|---|
| 1,907,254 | A | * | 5/1933 | Dodge | |
| 2,943,771 | A | * | 7/1960 | Driscoll | |
| 3,209,964 | A | * | 10/1965 | Knight | |
| 3,386,611 | A | * | 6/1968 | Crute | |
| 3,855,997 | A | * | 12/1974 | Sauer | |
| 3,964,631 | A | | 6/1976 | Albert | |
| 3,967,748 | A | | 7/1976 | Albert | |
| 3,972,443 | A | | 8/1976 | Albert | |
| 4,083,467 | A | * | 4/1978 | Mullins et al. | |
| 4,099,642 | A | | 7/1978 | Nergard | |
| 4,133,446 | A | * | 1/1979 | Albert | |
| 4,190,173 | A | * | 2/1980 | Mason et al. | |
| 4,303,173 | A | | 12/1981 | Nergard | |
| 4,319,690 | A | * | 3/1982 | Birrell et al. | |
| 4,501,376 | A | * | 2/1985 | Bushby | |
| 4,544,063 | A | * | 10/1985 | Neward | 220/253 |
| 4,548,331 | A | * | 10/1985 | Montgomery | 220/253 |
| 4,606,893 | A | * | 8/1986 | Sangster | 220/253 X |
| 4,624,384 | A | | 11/1986 | Ko | |
| 5,072,849 | A | * | 12/1991 | Blau | |
| 5,249,703 | A | | 10/1993 | Karp | |
| 5,294,014 | A | * | 3/1994 | Wyatt et al. | 220/253 |
| D362,156 | S | | 9/1995 | Goto et al. | |
| 5,449,085 | A | * | 9/1995 | Brun, Jr. | |
| 5,449,086 | A | * | 9/1995 | Harris | |
| 5,680,951 | A | * | 10/1997 | Feltman, III et al. | 220/253 |
| 5,687,710 | A | * | 11/1997 | Ambrosio et al. | |

(Continued)

FOREIGN PATENT DOCUMENTS

| | | | |
|---|---|---|---|
| GB | 2181418 | * | 4/1987 |

OTHER PUBLICATIONS

The Thermos Company, Travel Mug JMD 500, magazine, USA.

(Continued)

*Primary Examiner* — Robin Hylton
(74) *Attorney, Agent, or Firm* — Black Lowe & Graham PLLC

(57) ABSTRACT

A three position, selectively openable twist lid for a drinking vessel has separate drinking and venting apertures. The lid has two parts—a base member and a cap member. The base and cap members can be relatively rotated from a first, closed position to a second, open position and to a third, disengaged position in which the cap and base members may be separated for cleaning.

21 Claims, 3 Drawing Sheets

U.S. PATENT DOCUMENTS

| | | | | |
|---|---|---|---|---|
| D398,187 | S | 9/1998 | Parker | |
| 5,890,619 | A * | 4/1999 | Belanger | 220/713 |
| 5,901,902 | A * | 5/1999 | Grabber | |
| 6,003,711 | A * | 12/1999 | Bilewitz | |
| 6,010,029 | A * | 4/2000 | Wang | |
| 6,202,902 | B1 * | 3/2001 | Starr | |
| 6,216,903 | B1 * | 4/2001 | Hirose et al. | 220/253 |
| 6,216,904 | B1 * | 4/2001 | Cagan | 220/253 |

OTHER PUBLICATIONS

Contemporary Classics, The Traveler Car Mug, catalog, USA.
Contemporary Classics, Mobile Mug, catalog, USA.
Oggi Corporation, Travelmaster, The Gourmet Retailer, Apr. 1995, p. 167, USA.
Contemporary Classics, 1996 Centennial Olympic Collextion, catalog, USA.
The Thermos Company, Unbreakable Mugs JMC 250G, magazine, USA.
The Thermos Company, Vacuum Insulated Mug JMJ 180/JMJ 350, magazine, USA.
Pacific Market, Inc., (design sold at least as early as 1996).
Pacific Market, Inc., (design sold at least as early as Apr. 1996).
Pacific Market, Inc., (design sold as least as early as 1994).

* cited by examiner

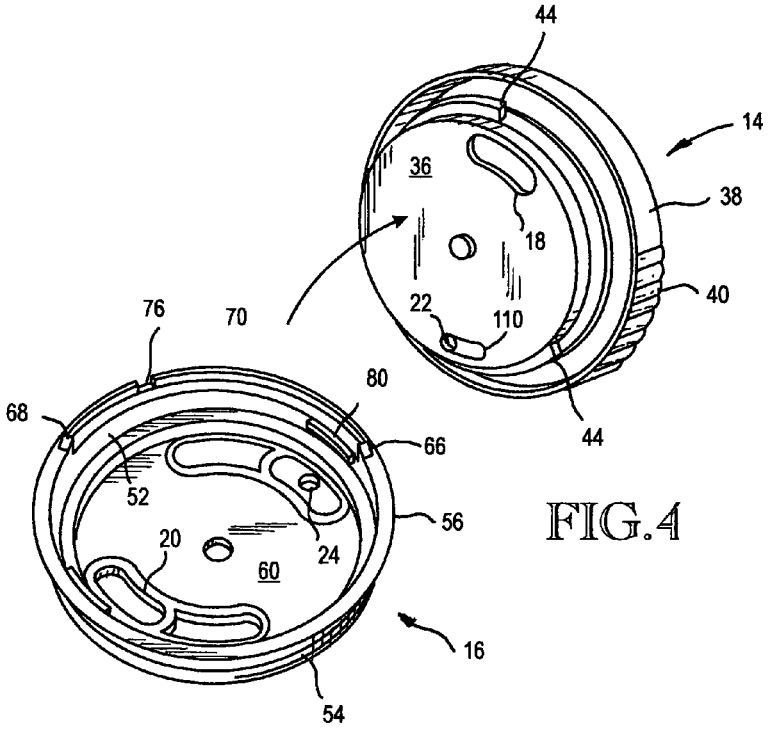
FIG.4
FIG.5
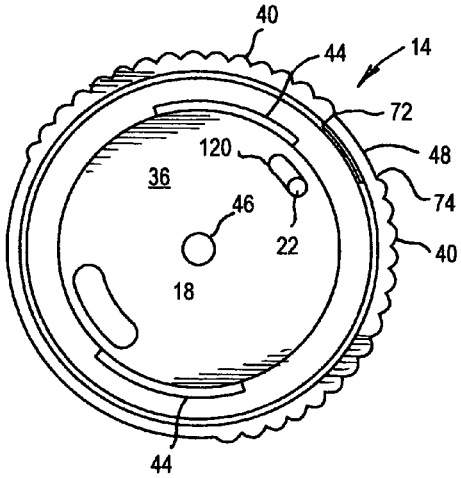
FIG.6
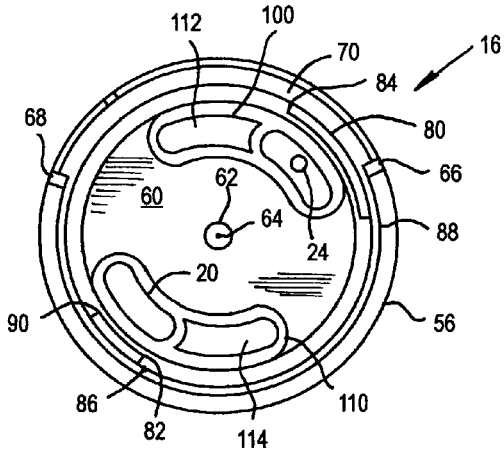

FIG.7
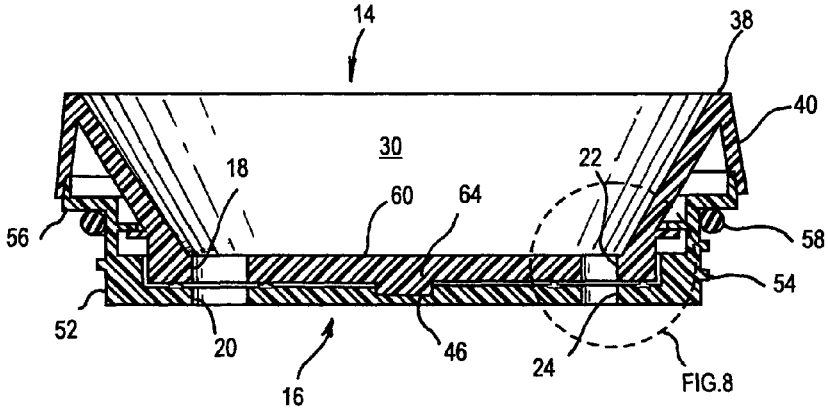
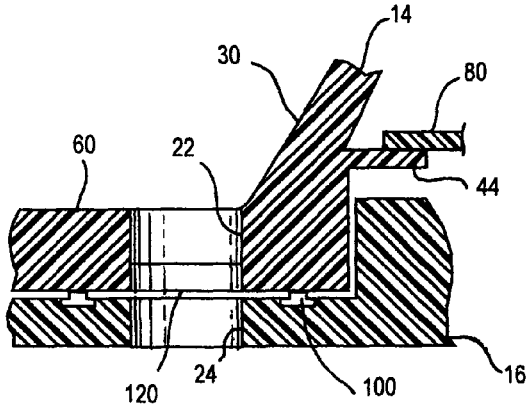
FIG.8

HYGIENIC TWIST LID FOR INSULATED BEVERAGE CONTAINER

TECHNICAL FIELD

The invention relates to removable lids for beverage containers. More specifically, the invention relates to a selectively openable twist-type lid for an insulated beverage container.

BACKGROUND OF THE INVENTION

Thermally insulated beverage containers have become increasingly popular with the public for use with hot beverages, such as coffee. Containers of this type may also be used for cold beverages as well. Hot beverages, such as coffee and tea, impose the most demanding thermal requirements on such a container. As a result, consumers have come to appreciate that double walled, vacuum insulated containers perform this function best. Such containers have sidewalls often manufactured from metal, particularly stainless steel to withstand the high mechanical loading due to atmospheric pressure. Thermally insulated beverage containers designed for keeping cold beverages from becoming, warm typically place a lower thermal load on the beverage container. As a result, such containers are often manufactured with a plastic double wall, wherein the interstitial space between the inner and outer walls is either thermally insulated with air or a foamed material.

In either case, it is highly desirable to provide a selectively openable lid for the beverage container. The lid performs at least two functions, the first of which is to prevent the beverage from spilling out of the container when the user is not actually drinking the beverage. This feature is particularly important when a hot beverage is in the container so as to prevent the user from becoming burned if the container tips over. As a second function, the lid should provide for drinking the fluid at a continual rate to prevent splashing or dribbling when the beverage is being drunk from the container. The lids for such containers are therefore typically provided with an open position, a closed position, and a third position in which the lid can be removed from the beverage container for cleaning. An example of a travel mug having a three-position, rotatable lid of the type described above is disclosed in U.S. Pat. No. 5,249,703 to Karp. That patent discloses a travel mug having two inwardly directly circumferential ears defining a gap region therebetween. A rotatable lid, having radially directed arms emanating from a central region at the bottom of the lid are adapted to pass through the gaps in the ears, and when rotated with the lid engage an underside of the circumferential rim of the lid with the radially inward directed ears. The rim is provided with diametrically opposed apertures to permit fluid to egress from the mug while air enters in through the remaining aperture to equalize pressure within the mug. The disclosure of this patent is incorporated herein by reference. One particular problem with this prior art design is that the drinking vessel must be specially manufactured with dedicated structure to engage the arms of the lid. In addition, although the lid is substantially splashproof when the lid is in the closed position, it is not leakproof if the mug is tipped over.

It has become increasingly common for users to employ thermally insulated beverage containers, particularly of the type best adapted for insulating hot beverages such as coffee, in moving vehicles, such as automobiles. One design branch in the prior art has attempted to provide a lid for such containers which is easily operated by a single hand between an open and closed position so that the user does not inadvertently spill a hot beverage on herself while driving her car. Lids of this type often employ a push button mechanism having a normally closed position. Examples of such prior art devices are shown in the following patents: U.S. Pat. No. 4,303,173 to Nergard; U.S. Pat. No. 3,964,631 to Albert; U.S. Pat. No. 3,967,748 to Albert; and U.S. Pat. No. 4,099,642 to Nergard. With respect to the lids disclosed in the above-identified patents, the user typically depresses a button near the rim of the lid to remove a stopper-like device from an aperture in the lid. Releasing the button returns the stopper to its normally closed position. Although devices of this type perform their intended function well, they have a significant unanticipated drawback. Specifically, the position of a stopper in a normally closed position provides an ideal breeding ground for bacteria in the junction between the stopper and the lid drinking aperture. In order to properly clean a lid of this type which quickly becomes fouled with such bacterial growth, the user must manually clean the lid by holding the mechanism open while using a brush or the like. It has been found that merely placing such lids in a dishwasher or the like will not adequately clean the area of contact between the stopper and the lid. Most users of this type of device find the requirement to manually wash the lid so inconvenient that they frequently will not purchase a second product of the same design.

Therefore a need exists for a splashproof and leakproof lid for an insulated beverage container which provides a truly leakproof and spillproof design in both an open and closed position, which does not encourage bacterial growth between moveable parts of the lid, and which is easily cleaned by the user.

SUMMARY OF THE INVENTION

It is therefore an object of the present invention to provide a removable lid for an insulated beverage container having leakproof and spillproof open and closed positions.

It s yet another object of the invention to provide the above-described object with a removable lid which does not encourage bacterial growth between moving parts of the lid.

It is yet another object of the present invention to achieve the above objects in a removable lid which is easy to clean.

The invention achieves these objects, and other objects and advantages which will become apparent from the description which follows, by providing a selectively openable lid for a drinking vessel having relatively rotatable base and cap members. Each member has drinking and venting apertures that are rotatably alignable with respect to one another to form a first, closed position and a second, open position. Fluid seals between the base and cap member provide substantially leakproof fluid conduits between the respective venting and drinking apertures in the base and cap members when the members are in the second, open position, and isolate interstitial areas between the members from the drinking and venting apertures when the members are in their first, closed position.

An alternate embodiment of the invention provides a structure to delimit the relative rotation of the cap and base members to the first and second positions described above, as well as to a third position in which the cap and base members are disengageable so that they may be cleaned by immersion in a dishwasher or the like without the need for an individual to physically maintain the members in a separate condition against spring pressure or the like. The lid can also be provided with a detent mechanism to discourage inadvertent relative rotation of the members from the first, closed position to the third, disengaged position. The base and cap members are preferably provided with corresponding bayonet ears for relative rotational engagement therebetween. In addition, a rotational bearing in the form of a spindle and arbor can be provided to guide the relative rotation of the cap and base members.

The cap and base member can be provided with substantially any external geometric appearance, however a circular appearance is preferred to coincide with the substantially circular cross-sectional dimension of most beverage containers. In addition, the cap member is preferably provided with a depressed central region to form a drinking basin for the user.

BRIEF DESCRIPTION OF THE DRAWINGS

FIG. 4 is an exploded, isometric view of base and cap members of the invention.

FIG. 5 is a bottom plan view of the cap member of the invention.

FIG. 6 is a top plan view of the base member of the invention.

FIG. 7 is a cross-sectional, side elevational view of the lid taken along lines 7-7 of FIG. 3.

FIG. 8 is an enlarged, partial cross-sectional view of the circled area indicated in FIG. 7.

DETAILED DESCRIPTION OF THE PREFERRED EMBODIMENTS

Figure 1:
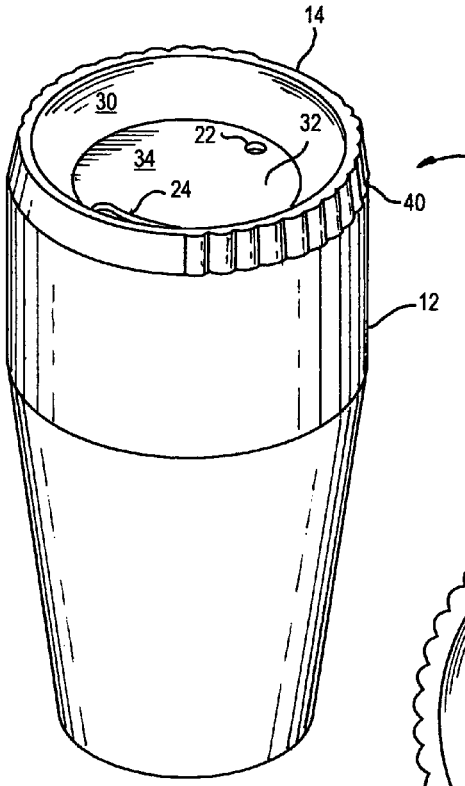
FIG. 1 is an isometric, perspective view of the selectively openable lid of the present invention in use with a generic drinking vessel.

A three-position, selectively openable lid is generally indicated at reference numeral 10 for use with a thermally insulated beverage container 12, as shown in FIG. 1. The lid 10 has substantially circular cap and base members, generally indicated at reference numerals 14 and 16 in FIGS. 4, 5 and 6. The cap and base members each have corresponding drinking apertures 18, 20 and venting apertures 22, 24. The cap and base members 14, 16 are relatively rotatably moveable with respect to one another from a first closed position shown in FIG. 2, wherein the cap member drinking and venting apertures 18, 22 and the base member 16 drinking and venting apertures 22, 24 are out of respective registration with one another, to a second, open position shown in FIG. 3 wherein the apertures are in registration with one another due to rotation of the cap and base members in a clockwise direction 26 of approximately 30 degrees. The cap and base members are also moveable to a third, disengaged position shown in FIG. 4 by further rotating the cap member with respect to the base member in the counter clockwise direction 30 degrees from the first, closed position.

Figure 2:
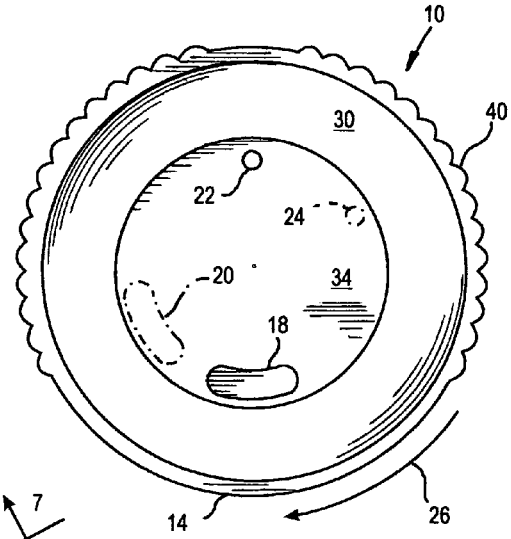
FIG. 2 is a top plan view of the lid in a closed position.
Figure 3:
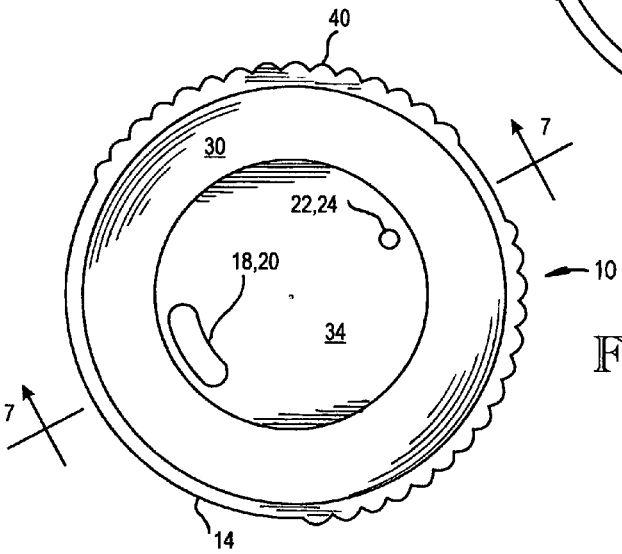
FIG. 3 is a top plan view of the lid in an open position.

As will be apparent to those of ordinary skill in the art, when the lid 10 is in the first closed position shown in FIG. 2, a user may not drink from the beverage container 12, whereas when the lid is in the second open position, shown in FIG. 3, the user may drink from the beverage container 12. The user may also separate the cap and base members 14, 16, as shown in FIG. 4, for cleaning, such as in a dishwasher.

The cap member 14 has an inwardly tapered and downwardly directly circular sidewall 30, defining a depressed drinking basin 32 having an upper surface 34 and a lower surface 36, defining the drinking and venting apertures 18, 22. The cap member 14 also has a downwardly depending external, circumferential flange 38, having a knurled region 40 for grasping the cap member and rotating the same with respect to the base member 16. As best seen in FIGS. 4 and 5, the cap member sidewall 30 has on its outer side diametrically opposed and laterally extending bayonet ears 44, each subtending an angle of approximately 60 degrees. The lower surface 36 of the cap member also supports a downwardly directed, cylindrical projection or spindle 46, for guiding relative rotation of the cap and base members 14, 16. The external flange 38 of the cap member 14 supports a downwardly directed, arcuate projection or timing cam 48 for limiting relative rotation of the cap and base members 14, 16. The timing cam subtends an angle of approximately 22.5 degrees.

As best seen in FIGS. 4, 6 and 7, the base member has a substantially circular sidewall 52 having external threads 54 adapted for mating with corresponding threads (not shown) on an inside surface of the beverage container 12. The sidewall 52 has, at an upper end thereof, a circumferential rim 56 which supports an O-ring 58 on the underside of the rim for forming a fluid-tight seal with the beverage container 12. The sidewall 52 also defines a substantially flat, depressed floor region 60 which defines the drinking and venting apertures 20, 24. An upper surface of the floor region also defines a depressed central arbor 62 having sidewalls which form a bearing surface for the spindle 46. The arbor, itself, has a floor 64 to prevent fluid from the beverage container from passing into the upper surface of the floor region 60 other than through the drinking or venting apertures 20, 24.

As best seen in FIGS. 4 and 6, the rim 56 of the base member 16 also has first and second delimiting stop members 66, 68 which project upwardly from the rim. The stop members are separated by an angular distance of approximately 145 degrees and form a receiving channel 70 for the timing cam projection 48. When the cap member 14 is rotated clockwise from the second, open position as shown in FIG. 3, through the first, closed position as shown in FIG. 2, to the third, disengaged position shown in FIG. 4, the timing cam 48 has its trailing edge 72 initially in contact with the second delimiting stop member 68 until the timing cam's leading edge 74 comes into contact with the first delimiting stop member 66. As defined herein, the "leading edge" of a structural member is defined as the surface which is first encountered when the cap member 14 is rotated in a counter clockwise direction as shown in FIGS. 1 through 3. The receiving channel 70 is provided with a ramp-like detent structure 76 located approximately one-third of the distance from the second delimiting stop member 68 to the first delimiting stop member 66. The detent structure 76 discourages inadvertent rotation of the cap member 14 in a counter-clockwise direction from the first, closed position to the third, disengaged position unless the user imparts sufficient torque to the cap member to resiliently deform the timing cam 48 so that it may pass over the detent structure 76.

In contrast to the symmetrical, diametrically opposed bayonet ears 44 on the cap member 14, the base member 16 has first and second inwardly directed bayonet ears 80, 82 on an inner surface of the circular sidewall 52. The leading edges 84, 86 of the bayonet ears 80, 82 are diametrically opposed with respect to the center of arbor 62. However, the first bayonet ear 80 subtends an angle of approximately 60 degrees, whereas the second bayonet ear 86 subtends an angle of approximately 30 degrees. Thus, the trailing edges 88, 90 are not diametrically opposed. This asymmetrical structure permits the cap member 14 to be released from the base member 16 when the timing cam leading edge 72 is in contact with the first delimiting stop member 66.

As best seen in FIGS. 6 and 8, the base member 16 is provided with a venting aperture seal 100 and a drinking aperture seal 110. The seals are preferably manufactured from food grade silicon or rubber and are in the shape of an arcuately deformed figure-8. One portion of the figure-8 portion of each seal circumscribes the respective drinking or venting aperture. The remaining portion of the figure-8 shaped seal circumscribes empty areas 112, 114 of the floor region 60 of the base member 16. As will be apparent to those of ordinary skill in the art, when the cap and base members 14, 16 are in the first, closed position as shown in FIG. 2, the drinking and venting apertures 20, 24 of the base member 16 are in registration with the smooth, lower surface 36 of the cap member 14, which are surrounded by portions of the figure-8 shaped seals 100, 110. Thus, the lower surface 36 of the cap member 14 and substantially all of the floor region 60 of the base member 16 remain uncontaminated by fluid from the drinking vessel 12. Similarly, when the cap and base members 14, 16 are in the second, open position shown in FIG. 3, the drinking and venting apertures 18, 20 and 22, 24 are in registration and also surrounded by closed portions of the seals 100, 110. Thus, the lower surface 36 and floor region 60 also remain uncontaminated by fluid in the beverage container 12 when a user is drinking therefrom. The assignee of the present invention has discovered that by fluidly isolating the drinking and venting apertures from the remaining structure of the lid 10, the lid remains substantially sanitary for much longer periods of time as compared to prior art designs. Eventually, when it is necessary to clean the respective parts of the lid, the user can easily disassemble the lid as shown in FIG. 4 and place the parts in a dishwasher or the like for cleaning and sanitization.

In view of the above, the cap and base members 14, 16 are preferably manufactured from a food grade thermo-plastic elastomer such as acrylonitrile butadiene styrene (ABS) or another suitable injection molded polymer. The seals 100, 110 and the O-ring 58 are preferably manufactured from food grade silicon, rubber or another suitable material. The knurled region 40 is preferably a rubberized material adhered to or ultrasonically welded onto the external flange 38.

Another feature of the invention is disclosed in FIG. 4. The invention provides for gradual release of pressure when the lid 10 is rotated from the closed to open position. Such pressure may undesirably form inside the drinking vessel 12 when there is a drop in ambient temperature while the lid is in the closed position and a hot beverage is stored in the vessel. If the vessel is full, some of the fluid may be undesirably ejected from the venting aperture 22. To provide a circuitous path for release of such pressure, the venting aperture 22 is provided with a lower, arcuate depression or rebate 120. The rebate has a depth of approximately one-half of the thickness of the drinking basin 32 and has a length of approximately one-quarter inch. As best seen in FIG. 6, the rebate 120 and venting aperture 22 are preferably totally circumscribed by the portion of seal 100 which encloses empty area 112 when the lid 10 is in the closed position. When the lid is rotated towards the open position from the closed position, the rebate 120 clears the empty area 112 first. This provides a small, indirect venting pathway from inside the vessel 12 to outside of the vessel to gently release any such pressure.

Other alternate embodiments of the invention are contemplated which will be apparent to those of ordinary skill in the art upon reviewing the above disclosure. For example, the seals 110, 112 can be placed on the lower surface 36 of the drinking basin 32 while the floor region 60 of the base member 16 can be made substantially smooth. In addition, the orientation of the bayonet ears described above can be reversed with the symmetrical bayonet ears being positioned on the base member 16, and the asymmetrical bayonet ears being placed on the cap member 14. The timing arrangements of the stop members 66, 68, timing cam 48, and relative positions of the drinking and venting apertures can all be rearranged in accordance with the design choice of those of ordinary skill in the art in accordance with the concepts of the invention as discussed above. Therefore, the invention is not to be limited by the above disclosure but is to be determined in scope by the claims which follow.

We claim:

1. A selectively openable lid for a drinking vessel, comprising:

a circular base member having mounting means thereon for removably connecting the base member to a drinking vessel, the base member further having a downwardly depending base member side wall defining a depressed floor region having upper and lower surfaces and drinking and venting apertures, wherein an inwardly directed surface of the side wall has a plurality of opposed bayonet ears thereon;

a circular cap member for rotational engagement with the base member, the cap member having a downwardly depending cap member side wall defining a depressed drinking basin having upper and lower surfaces and drinking and venting apertures positioned and sized so as to correspond to the drinking and venting apertures in the base member, wherein an outwardly directed surface of the cap member side wall has a plurality of opposed bayonet ears thereon positioned and sized for corresponding engagement with the bayonet ears on the base member;

first seal means between the cap and base members for forming a fluid conduit between the corresponding drinking and venting apertures when said apertures are in respective rotational registration with one another, so that interstitial areas between the cap and base members are fluidly isolated from the apertures and remain substantially uncontaminated by drinking fluid from the drinking vessel when the cap member is in a first, open position; and, second seal means between the cap and base members for forming a fluid barrier between the corresponding drinking and venting apertures when the cap member is in a second, open position and said apertures are out of respective rotational registration with one another, so that the interstitial areas between the cap and base members are fluidly isolated from the base member apertures and remain substantially uncontaminated by drinking fluid from the drinking vessel when the cap member is in the second, open position.

2. The selectively openable lid of claim 1, including timing means for limiting relative rotation of the cap and base members from the first, closed position through the second, open position and to a third disengaged position wherein the corresponding bayonet ears on the cap and base members are disengaged so that the members can be separated and cleaned.

3. The selectively openable lid of claim 2, wherein the timing means includes angularly spaced apart, upwardly directed, delimiting stop projections on the base member and a arcuately shaped, downwardly directed timing cam projection on the cap member positioned for angular movement between the stop projections.

4. The selectively openable lid of claim 3, wherein the timing cam subtends an angle of approximately 22.5 degrees and wherein the delimiting stops are angularly separated by an angle of approximately 145 degrees.

5. The selectively openable lid of claim 2, wherein the timing means includes a detent structure between the stop projections to discourage inadvertent relative rotation of the cap and base members from the second, open position to the third, disengaged position.

6. The selectively openable lid of claim 5, wherein the detent structure is a ramp member having reduced resistance to relative clockwise rotation of the cap and base members from the third, disengaged position to the second, open position as compared to relative counter clockwise rotation of the cap and base members from the second, open position to the third, disengaged position.

7. The selectively openable lid of claim 1, wherein the bayonet ears on the cap member are diametrically opposed and subtend an angle of approximately 60 degrees, wherein the bayonet ears on the base member also are diametrically opposed, and wherein a first one of the base member bayonet ears subtends an angle of approximately 60 degrees and a second one of the base member bayonet ears subtends an angle of approximately 30 degrees.

8. The selectively openable lid of claim 7, wherein leading edges of the base member bayonet ears are diametrically aligned.

9. The selectively openable lid of claim 1, wherein the cap member has a centrally disposed, cylindrical spindle depending downwardly from the lower surface of the drinking basin, and wherein the base member has a centrally located arbor for receipt of the cylindrical spindle for guiding relative rotation of the cap and base members.

10. The selectively openable lid of claim 1, wherein the first and second seal means include arcuately shaped ovoid gaskets in the upper surface of the base member floor and wherein the lower surface of the drinking receptacle is substantially smooth and adapted for sliding sealing engagement with the gaskets, except that the lower surface of the drinking receptacle has a rebate adjacent to the venting aperture for gradual release of pressure in the drinking vessel.

11. A selectively openable lid for a drinking vessel, comprising:

a base member having a substantially closed floor region defining upper and lower surfaces and drinking and venting apertures, and having a plurality of opposed base member bayonet ears thereon;

a circular cap member for rotational engagement with the base member, the cap member defining a depressed drinking basin having upper and lower surfaces and drinking and venting apertures positioned and sized so as to correspond to the drinking and venting apertures on the base member, and a plurality of opposed cap member bayonet ears positioned thereon and sized for corresponding engagement with the base member bayonet ears;

seal means between the cap and base members for forming a fluid conduit between the corresponding drinking and venting apertures when said apertures are in respective rotational registration with one another and for forming a fluid barrier between the corresponding drinking and venting apertures when said apertures are out of respective rotational registration with one another, so that interstitial areas between the cap and base members are fluidly isolated from the base member apertures and remain substantially uncontaminated by drinking fluid from the drinking vessel when the cap member is in a first, closed and second, open position.

12. The selectively openable lid of claim 11, including timing means for limiting relative rotation of the cap and base members from the first, closed position through the second, open position and to a third, disengaged position wherein the corresponding bayonet ears on the cap and base members are disengaged so that the members can be separated and cleaned.

13. The selectively openable lid of claim 12, wherein the timing means includes angularly spaced apart, upwardly directed, delimiting stop projections on the base member and an arcuately shaped downwardly directed timing cam projection on the cap member positioned for angular movement between the stop projections.

14. The selectively openable lid of claim 13, wherein the timing cam subtends an angle of approximately 22.5 degrees and wherein the delimiting stops are angularly separated by an angle of approximately 145 degrees.

15. The selectively openable lid of claim 12, wherein the timing means includes a detent structure between the stop projections to discourage inadvertent relative rotation of the cap and base members from the second closed position to the third disengaged position.

16. The selectively openable lid of claim 15, wherein the detent structure is a ramp member having reduced resistance to relative clockwise rotation of the cap and base members from the third, disengaged position to the second, open position as compared to relative counter clockwise rotation of the cap and base members from the second, open position to the third, disengaged position.

17. The selectively openable lid of claim 11, wherein the bayonet ears on the cap member are diametrically opposed and subtend an angle of approximately 60 degrees, wherein the bayonet ears on the base member also are diametrically opposed, and wherein a first one of the base member bayonet ears subtends an angle of approximately 60 degrees and a second one of the base member bayonet ears subtends an angle of approximately 30 degrees.

18. The selectively openable lid of claim 17, wherein leading edges of the base member bayonet ears are diametrically aligned.

19. The selectively openable lid of claim 11, wherein the cap member has a centrally disposed, cylindrical spindle depending downwardly from the lower surface of the drinking basin, and wherein the base member has a centrally located arbor for receipt of the cylindrical spindle for guiding relative rotation of the cap and base members.

20. The selectively openable lid of claim 11, wherein the base member is circular and has means thereon for releasably mounting the base member to a drinking vessel.

21. The selectively openable lid of claim 20, wherein the mounting means has a downwardly depending side wall having an external thread for engagement with external threads on the drinking vessel and wherein the base member further has an "O" ring seal adjacent the threads and positioned for sealing engagement with the drinking vessel.

* * * * *